United States Patent [19]

Goyal et al.

[11] Patent Number: 4,832,823

[45] Date of Patent: May 23, 1989

[54] COKING PROCESS WITH DECANT OIL ADDITION TO REDUCE COKE YIELD

[75] Inventors: Shri K. Goyal, Naperville, Ill.; Gary S. Faagau, Newport News, Va.

[73] Assignee: Amoco Corporation, Chicago, Ill.

[21] Appl. No.: 40,845

[22] Filed: Apr. 21, 1987

[51] Int. Cl.[4] ..... C10G 9/14

[52] U.S. Cl. ..... 208/131; 208/50

[58] Field of Search ..... 208/131, 127, 50

[56] References Cited

U.S. PATENT DOCUMENTS

| | | | |
|---|---|---|---|
| 2,922,755 | 1/1960 | Hackley, Jr. | 208/39 |
| 3,493,489 | 2/1970 | Naniche | 208/50 |
| 3,759,822 | 9/1973 | Folkins | 208/131 |
| 3,891,538 | 6/1975 | Walkey | 208/50 |
| 3,896,023 | 7/1975 | Ozaki et al. | 208/50 X |
| 4,066,532 | 1/1978 | Garcia | 208/131 |
| 4,075,084 | 2/1978 | Skripek et al. | 208/131 X |
| 4,235,703 | 11/1980 | Kegler et al. | 208/131 X |
| 4,312,745 | 1/1982 | Hsu et al. | 208/131 X |
| 4,518,487 | 5/1985 | Graf et al. | 208/131 |

*Primary Examiner*—Glenn Caldarola

*Attorney, Agent, or Firm*—Robert E. Sloat; William M. Magidson; Ralph C. Medhurst

[57] ABSTRACT

An improved coking process is described wherein a feedstock comprising residual oil is passed into a coking zone along with a highly aromatic oil such as pyrolysis tars or a decanted oil produced from a fluidized catalytic cracking zone in a concentration resulting in the feedstock having froma bout 5 to about 20 percent by weight of highly aromatic oil. The yield of coke is thereby reduced.

13 Claims, 4 Drawing Sheets

COKING PROCESS WITH DECANT OIL ADDITION TO REDUCE COKE YIELD

BACKGROUND OF THE INVENTION (1) Field of the Invention

This invention relates to an improved coking process which a highly aromatic oil is mixed with the residual feed passing into a coking zone. In a more specific instance this invention relates to an improved delayed coking process in which slurry oil, which has been decanted, is added to the residual oil feed to the delayed coking process.

(2) General Background

Coking operations in modern refineries produce solid coke, gaseous and liquid products from heavy residual feedstocks.

In the usual application of the coking process, residual oil is heated in a furnace, passed through a transfer line and discharged into either a coking drum or a fluidized coking unit. During coking the residual feedstock is thermally decomposed to a very heavy tar or pitch which further decomposes into solid coke and vapor materials. The vapors formed during decomposition are ultimately recovered from the coking zone and solid coke is left behind.

When a delayed coking operation is utilized, the residual oil is passed into a coking drum which eventually fills with a mass of solid coke. The vapors formed in the coking drum leave the top of the drum and are passed to a fractionating column where they are separated into liquid and gaseous products. Sometimes these products are recycled with residual feed to the coke drum.

In delayed coking operations the residual feed passing into the coking drum is stopped after a predetermined period and routed to another drum. The first drum is then purged of vapors, cooled and opened so the solid coke material which has filled the drum can be removed by drilling or other means.

In fluidized coking a residual feed contacts a previously produced hot fluidized bed of coke particles and is converted to additional coke material and lighter hydrocarbons. The coke in the fluidized bed is heated through external means which include either a gasification zone, where a part of the fluidized coke produced from the residual feed is burned with oxygen, or through heat exchange with a combustor.

In either type of coking operation the refiner generally aims to minimize coke production and maximize liquid products from a residual feed, since liquid products are more easily converted into gasoline or other product of higher value than solid coke.

Applicants have found when a highly aromatic oil containing above about 60 percent of its carbon atoms as aromatic carbons is added to the residual feed passed into the coking unit, reduction of solid coke yield and an increase in liquid yield occur. The addition of the highly aromatic oil in quantities of from about 5 to up to about 20 percent by weight of the total hydrocarbon feedstock being added to the coking unit is optimum, since very large concentrations of highly aromatic oil addition increase the coke yield when compared to additions in the 5 to 20 percent range.

Accordingly, any process improvement in a coking operation which decreases solid coke production and increases valuable liquid production is of interest to a refiner.

One method used to improve coker operations is disclosed in U.S. Pat. No. 3,493,489 (U.S. Class 208-50) where a combination of catalytic cracking and coking is used to increase liquid yields of heavy residual feedstocks. This patent discloses, at column 3, lines 20 through 25, that coker feed material can include the bottoms from the catalytic cracking effluent fractionation column which includes decanted or slurry oil materials. However this patent only generally teaches the use of catalytic cracking effluent fractionation bottoms and does not recognize that a specified percentage of a highly aromatic oil, such as a slurry or decanted oil, combined with the residual feed passing into a coker can produce increased valuable liquid yields while decreasing the coke yield in the coker.

U.S. Pat. No. 3,891,538 discloses the use of a decanted oil, comprising material boiling above about 800° F., which is passed into a coking zone along with residual feedstocks. No specific ratios of decanted oil to coker residual feeds are disclosed or suggested. It is interesting that the claims of this patent require an increased coke yield. Applicants' process results in a reduction in solid coke formation and an actual increase in the $C_5+$ liquids produced from the coking zone. As illustrated in FIG. 2, depending on the transfer line temperature in the coking operation, addition of highly aromatic oil, such as decanted oil from fluidized catalytic cracking unit, at concentrations above about 25 to 60 weight percent of the feed to the coking unit actually causes the coke yield to increase.

An article by N. P. Lieberman entitled "Shot coke: its origins and prevention," published at pages 45 and 46 of the July 8, 1985, issue of the *Oil and Gas Journal*, generally describes the use of additions of highly aromatic slurry oil at 5 percent concentrations to a delayed coker to reduce shot coke production.

This article does not recognize that a specific range of slurry oil concentrations can be used to reduce solid coke production and to increase $C_5+$ liquid yield from residual coker feeds.

In other known coking processes, feeds which comprise essentially 100 percent highly aromatic oil such as hydrotreated slurry or decanted oil produce premium needle coke in the coking operation. Needle coke is an especially valuable and highly specialized form of coke

SUMMARY OF THE INVENTION

The present invention can be summarized as an improved coking process in which residual oil is passed into a coking zone, wherein an improvement comprises mixing the residual feedstock with a highly aromatic oil having above about 60 percent of its carbon atoms as aromatic carbon wherein the resulting feedstock mixture contains from about 5 to about 20 percent by weight of the highly aromatic oil.

In a more specific instance, the residual oil feed boils within a range of from about 850° F. to about 1250° F. and the highly aromatic oil boils within a range of from about 450° F. to about 1150° F. In a more specific instance, the highly aromatic oil comprises a decanted oil containing catalyst solids resulting in less than about 1500 ppm by weight of silicon. In an even more specific instance, the solids in the decanted oil comprise fluidized catalytic cracking catalyst.

In another specific instance, the present invention is an improved delayed coking process using the above feedstock.

It is an object of the present invention to provide an improved coking process in which the feedstock to the coking zone is a mixture of residual oil and a highly aromatic oil which increases the liquid products produced from the coking zone and decreases the amount of solid coke produced in the coking zone. It is another object of the present invention to provide an improved delayed coking process using the above feedstock. It is still another object of the invention to provide an improved fluidized bed coking process using the above feedstocks. Another object of the present invention is to produce an improved solid coke product suitable for anode grade use. These and other objects will be apparent throughout this specification.

The present invention overcomes one of the main problems associated with commercially operated delayed coking or fluidized bed coking processes. The primary object of these commercial processes is to produce valuable liquid refinery products from residual feedstocks which normally boil within the range of from about 850° F. to about 1250° F. In producing the lighter liquid products, however, quantities of lower valued solid coke are also produced. This solid coke presents problems, since it is difficult to handle and competes with other low cost solid fuels. Accordingly, refiners attempt to reduce the amount of solid coke produced in any coking process while attempting to increase the valuable $C_5+$ liquid components produced. Also, refiners attempt to increase the value of the coke produced from residual feedstock by producing anode grade coke which is used in the aluminum industry.

The present invention gives the refiners the advantage of being able to decrease the production of coke in a fluid bed or delayed coking unit and increase the $C_5+$ liquids produced from the coking operation. An additional benefit associated with feeding a mixture of residual feedstock and from about 5 to about 20 weight percent of a highly aromatic second oil, is that the coke quality is also generally improved by decreasing its density which is the result of decreased volatile material in the coke. Decreased volatiles and density of the coke present an advantage in attempting to meet specifications for sale of this material to premium markets. In particular, the volatile or density level of the coke is an important specification used by the aluminum industry when purchasing anode grade coke.

Fuel grade coke produced from delayed coking operations using residual feeds, will generally have the following specifications: 1 to 7 weight percent sulfur; 8 to 20 weight percent volatiles; and 0.1 to 2 weight percent ash.

Needle grade coke which is produced from highly aromatic feeds such as decanted oil feedstocks is suitable for use in steel and specialty alloy applications will generally have the following specifications: 0.1 to 1 weight percent sulfur; 3 to 6 weight percent volatiles; 0.001 to 0.02 weight percent ash; and a coefficient of thermal expansion of 0.5 to $5\times10^{-6}$ cm/cm/°C.

Anode grade coke which is also produced from residual feeds is suitable for use in aluminum manufacturing applications will generally have the following specifications: 0.5 to 2.5 weight percent sulfur; 7 to 11 weight percent volatiles; 0.05 to 0.3 weight percent ash; a density of from about 0.75 to about 0.90 gm/cc; and a silicon content of about 200 ppm by weight maximum.

The volatiles measurement on coke is made using the ASTM D-3175 analytical procedure. Coke ash content is determined by the ASTM D-482 method. Coke density is measured by a procedure involving drying the coke at a temperature of about 250 ° F., grinding the dried coke, separating ground coke particles from −5 to +20 mesh, calcining the separated particles by placing them in an oven at 900° C. and heating to 1100° C. in 15 minutes, cooling and crushing, and placing −28 to +48 mesh particles in a cylinder on a vibrator and measuring the volume occupied by the resulting particles and their weight.

Addition of highly aromatic oils, also reduces the propensity to produce "shot coke" which produces hard and difficult to handle coke particles.

BRIEF DESCRIPTION OF THE DRAWINGS

The attached Figures show various aspects of the process of the present invention.

In FIG. 1 a gas oil passes through line 6 into catalytic cracking zone 1, which normally is a fluidized catalytic cracking process operation, in which the gas oil contacts a fluidized catalyst and is projected through a riser-type reactor after which the spent catalyst is separated from reaction products and regenerated by contact with air and reused in the reaction zone. Hydrocarbon products which generally constitute lighter materials are removed from the catalytic cracking zone 1 via line 7 and pass into fractionator 2, called a main column in the refining industry.

Figure 1:
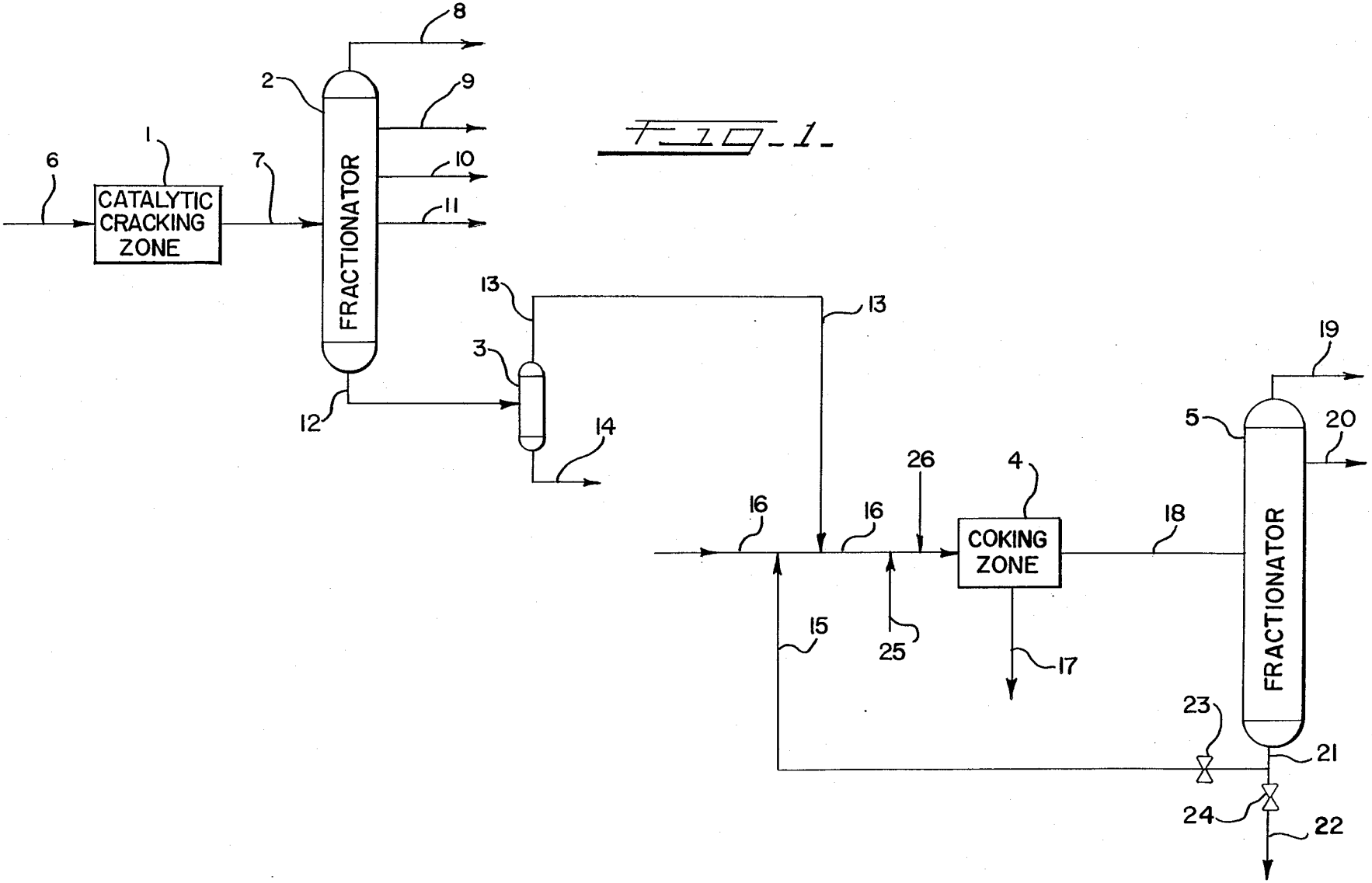
FIG. 1 illustrates a representative coking process of the present invention.

From fractionator 2, gaseous materials comprising $C_4-$ materials are removed through line 8. Gasoline is removed via line 9, and light and heavy cycle oils can be removed from via lines 10 and 11 respectively. The light and heavy cycle oils may be recycled together with the fresh feed passing through line 6.

From the bottom of fractionator 2 there is removed a heavy bottoms fraction through line 12. This heavy bottoms fraction passes into settler 3. The heavy bottoms fraction passing through line 12 is generally called slurry oil. Slurry oil generally contains up to a few weight percent of entrained catalytic cracking catalyst which is carried over from the cracking zone 1 into the fractionator 2. The slurry oil generally boils within a boiling range of from about 450° F. to about 1150° F. From settler 3, a stream comprising a very high concentration of catalyst can be removed via line 14 and a decanted oil stream is removed via line 13. The decanted oil is essentially the same as the slurry oil except that it contains much less entrained catalyst. Typically a decanted oil will contain up to about two weight percent of fluidized catalytic cracking catalyst solids.

In this specification, slurry oil and decanted oil can be characterized as the same material, namely the heavy fraction which is derived from the bottom of the fractionator receiving the fluidized catalytic cracking zone reaction products.

In cases where the slurry oil is passed into a settler or a side reboiler on fractionator 2, the material passing into the coking zone can be characterized as a decanted oil. The function of slurry oil or the decanted oil is the same in the coking zone, namely to decrease coke production and help increase liquid production from the coking zone.

Coking zone 4 can comprise a fluidized bed coker or a delayed coker. Passing into the coking zone through line 16 is a residual oil feedstock. A highly aromatic oil, as defined hereinafter, passes through line 25 into line 16 along with the residual oil and into coking zone 4. The highly aromatic oil can comprise decanted oil and in such case can pass directly from settler 3 via line 13 into line 16 and into coking zone 4. In instances where heavy oil from fractionator 5 is recycled to coking zone 4 through line 15 it can be blended with the residual oil feedstock passing through line 16.

From coking zone 4 a solid coke product can be removed via line 17 and upgraded liquid and gaseous vapor products can be removed through line 18 which passes into fractionator 5 (referred to in the industry as a combination tower). From fractionator 5 a $C_4-$ gaseous stream is removed via line 19. Through line 20 and other lines as are needed on the fractionator, the other liquid products produced from the coker can be removed. These include gasoline, distillates, gas oil and heavier residual-type materials. The heaviest materials from fractionator 5 can be removed through the bottom line 21. If this material is to be recycled to the coking zone through line 15, valve 23 can be opened. If no recycle to the coking zone of the heavy materials from fractionator 5 is desired these materials can be removed through open valve 24 via line 22.

Sometimes distillate recycle materials from fractionator 5 can pass through line 26 and be added to the feed in line 16 passing into the coking zone.

Figure 2:
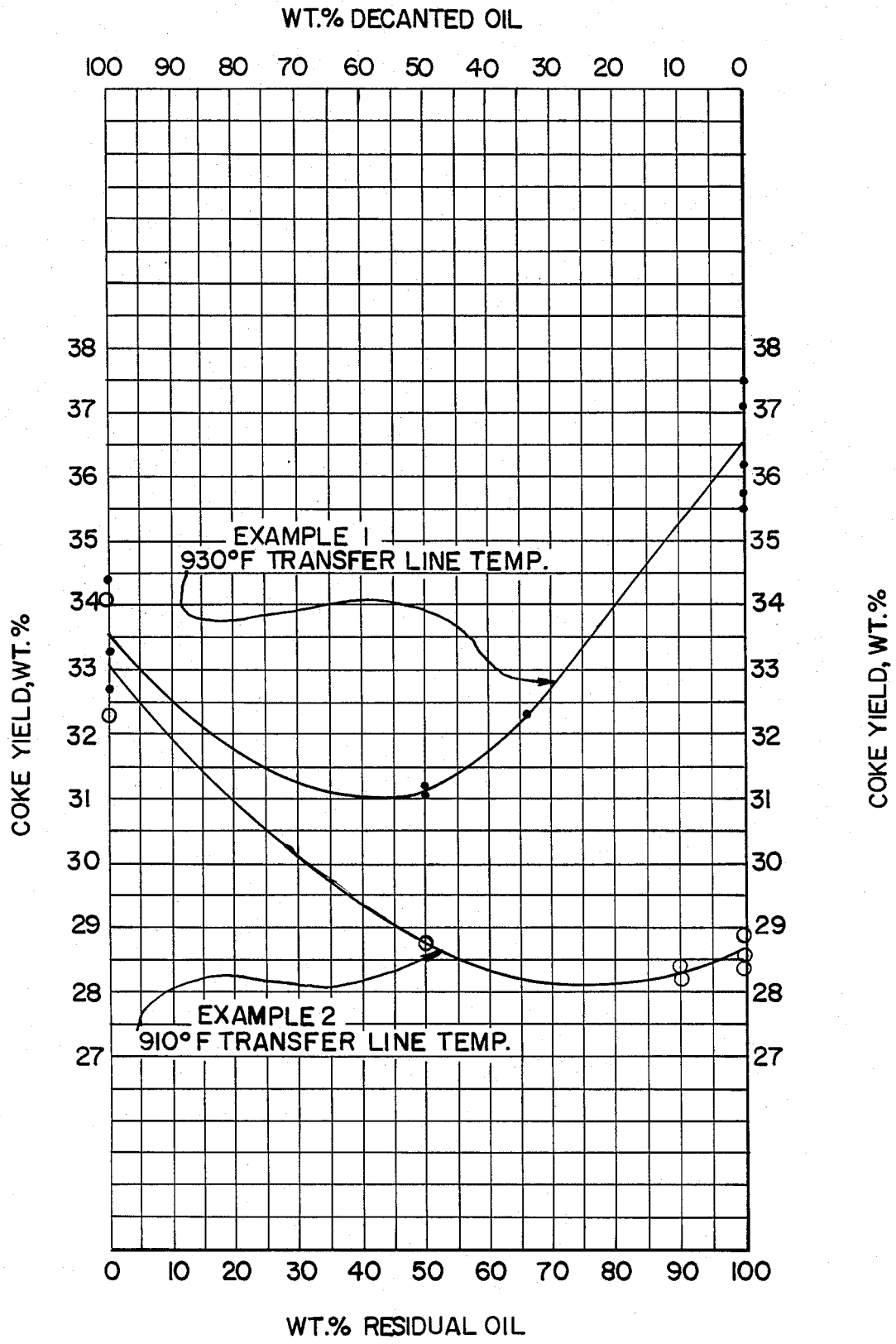
FIG. 2 is a graph of pilot plant data showing the effect of decant oil addition upon coke yields.
Figure 3:
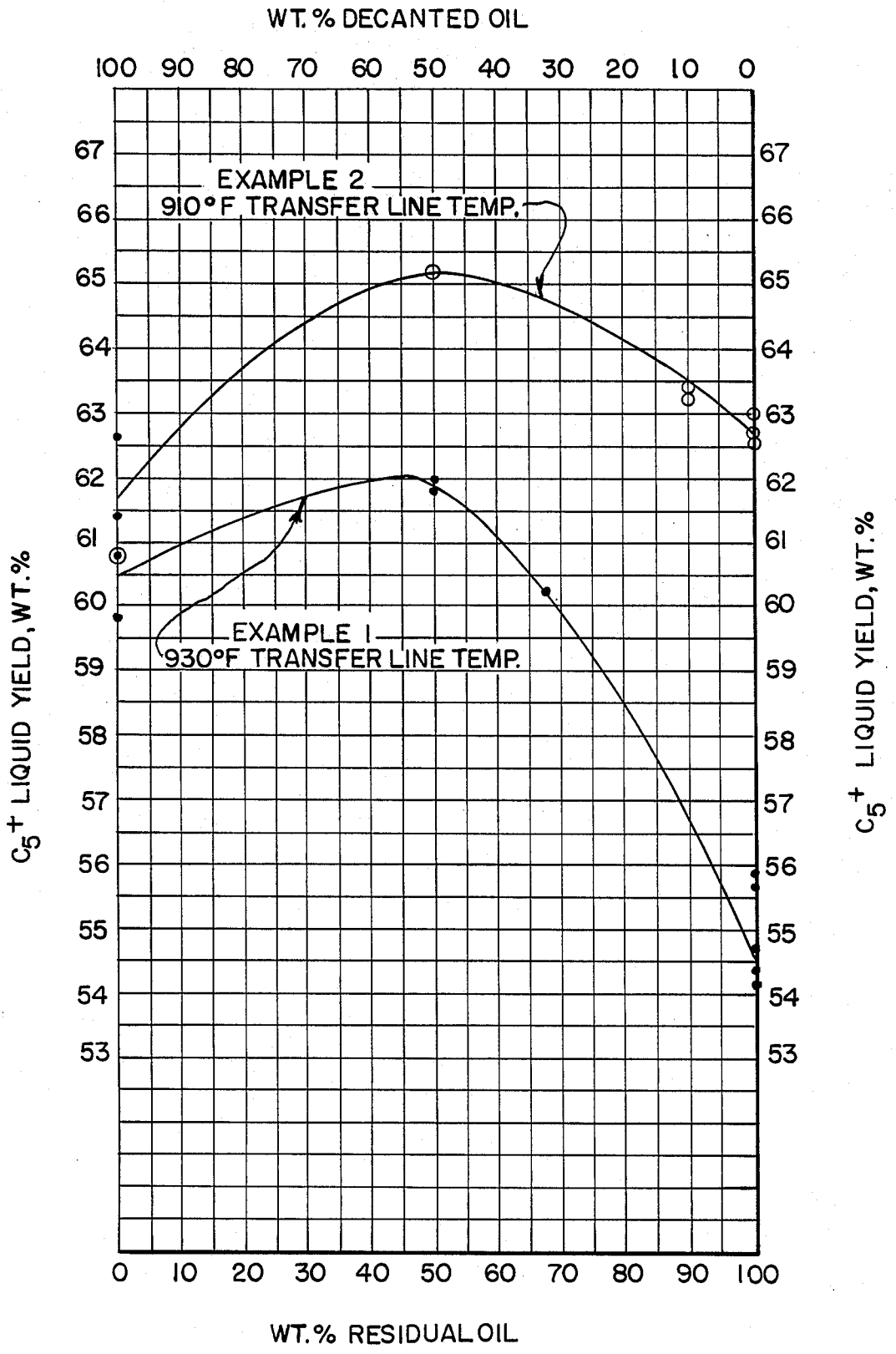
FIG. 3 is a graph depicting the relationship between decant oil addition upon $C_5+$ liquid yields.
Figure 4:
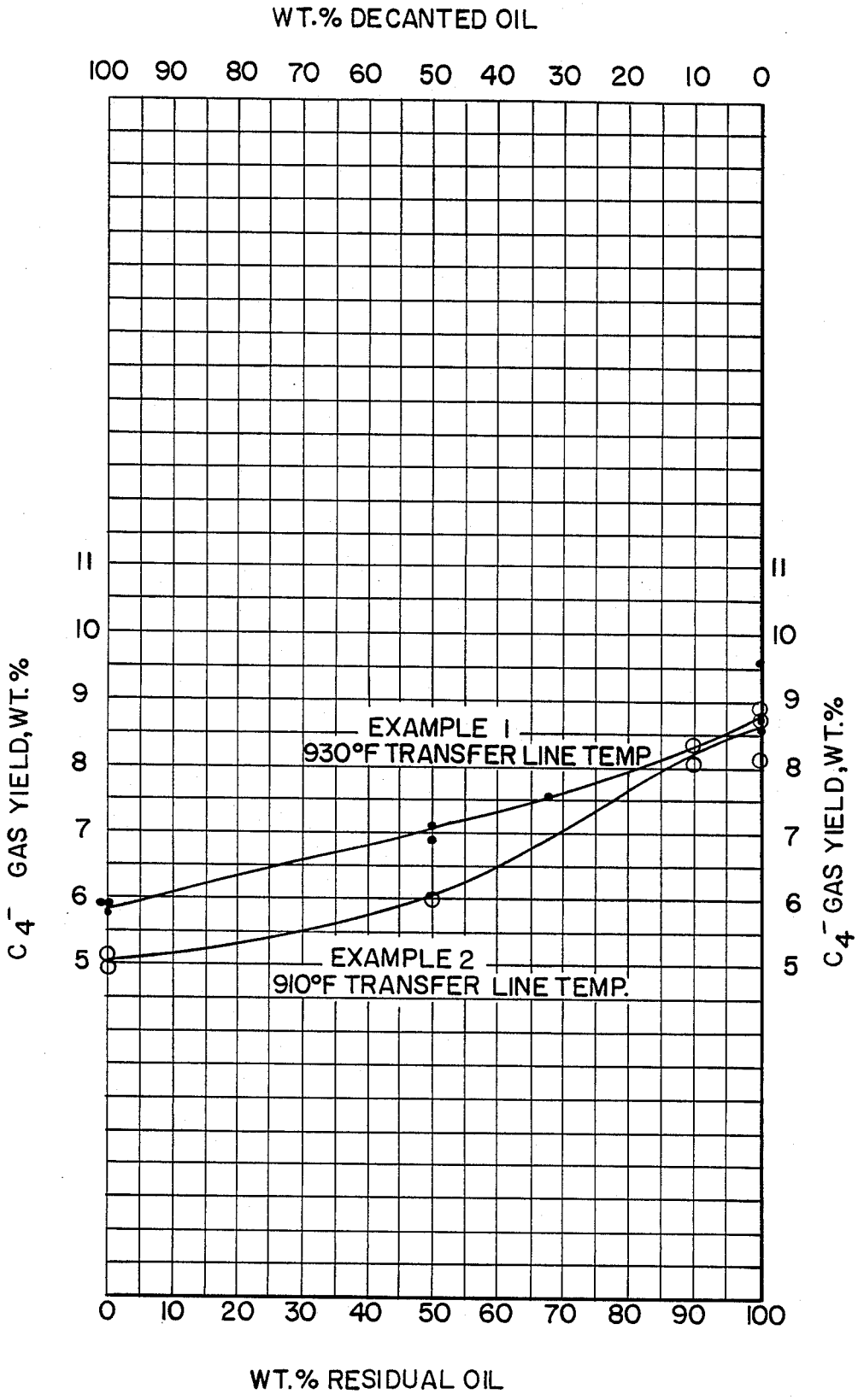
FIG. 4 is a graph which shows the effect of decant oil addition upon $C_4-$ gas yields.

FIGS. 2, 3 and 4 show yields obtained from pilot plant delayed coking experiments in which the amount of highly aromatic oil added to the residual feed was varied using transfer line temperatures of 910° F. and 930° F. respectively. Further discussion of the data reported in these Figures is in the Examples.

DESCRIPTION OF THE PREFERRED EMBODIMENT

In a broad embodiment, this invention relates to a coking process wherein a feedstock comprising residual oil is passed into a coking zone at coking conditions to effect tee production of coke, liquid and gaseous products, an improvement in the process wherein the feedstock is mixed with a highly aromatic oil having above about 60 percent of its carbon atoms as aromatic carbon, wherein the mixture of feedstock and highly aromatic oil contains from about 5 to about 20 percent by weight of said highly aromatic oil.

In a preferred embodiment, the invention relates to an improved delayed coking process wherein a feedstock comprising residual oil boiling within a range of from about 850° F. initial boiling point to about 1250° F. end boiling point is passed into a coking drum at coking conditions to effect the production of coke, liquid and gaseous products from said feedstock, an improvement in the process wherein said feedstock is mixed with a highly aromatic oil comprising a decanted oil having above about 60 percent of its carbon atoms as aromatic carbon and boiling within a range of from about 400° F. to about 1150° F. and containing less than about 1 percent by weight of fluidized catalytic cracking catalyst, an wherein the mixture of feedstock and highly aromatic oil contains from about 5 to about 20 percent by weight of said highly aromatic oil.

In a most preferred embodiment, the present invention relates to a process wherein a gas oil is converted in a fluidized catalytic cracking process zone to gasoline and other products including the production of decanted oil boiling in a range of from about 400° F. initial boiling point to about 1,150° F. end boiling point and containing less than about 4 weight percent solid particles comprising fluidized catalytic cracking catalyst used in said cracking zone, and wherein a coker feedstock comprising residual oil is passed into a delayed coking zone at coking conditions to effect the production of coke, liquid and gaseous products from said feedstock, an improvement in the process wherein the residual oil is mixed with said decanted oil which contains above about 60 percent of its carbon atoms as aromatic carbon to produce a coker feedstock having from about 5 to about 20 percent by weight of decanted oil.

Whether the coking operation takes place in a fluid coker or in a delayed coker, the coke formation reactions are essentially endothermic with the temperature dropping as the formation of coke, liquid and vapor products occur. In a delayed coking process, this temperature drop can start when the feed material leaves the feed furnace and passes through a line (referred to in the industry as the transfer line) which connects the feed furnace and the coke drum. A temperature drop also occurs in the delayed coking drum where most of the coking reaction occurs. In fluid coker operations, depending on whether a transfer line is used, the temperature drop can occur in such line and also in the initial portions of the fluid bed of coke where the feedstock enters the fluid coking zone.

In either fluidized or delayed coking operations, the residual feed passed into the coking zone is generally heated to a transfer line temperature anywhere from around 850° F. to about 970° F., preferably around 900° F. to about 950° F. Pressures generally are regulated anywhere from atmospheric to about 250 psig, but preferably from about 15 to about 150 psig. Vapor residence times in the coke drum or the fluidized coking vessel can vary anywhere from about 2 seconds up to 2 minutes. Steam can be added to the feed passing into the coking at rates ranging from about 0.2 up to about 5 pounds of steam per hundred pounds of total feed passing into the coking process. The above general operating ranges are called "coking conditions" through this specification and claims.

In the delayed coking process, feed can be passed directly to a preheat furnace or to a main fractionator depending on whether the operator desires "once-through" operation. If some coker product recycle occurs, the coker feed material can be combined with the recycled material and pumped into a coker furnace where it is heated to coking temperatures which produce partial vaporization and mild cracking. The vapor-liquid mixture generally passes through a transfer line connecting the furnace and coke drum and into the coking drum. In the drum, vapor experiences further cracking and liquid experiences cracking and polymerization until it is converted to a vapor and coke.

Coke drum overhead vapors are removed from the drum and enter the fractionator or combination tower and are separated into various products including gas, naphtha, light and heavy gas oils.

In fluid bed coking a residual feed is heated and contacted with a fluidized bed of hot coke particles which have been previously produced. The feedstock cracks yielding a wide range of vapor products plus coke. Products other than coke are quenched in an overhead scrubber where any entrained coke is removed. Sometimes, a heavy fraction of the vapor materials removed from the fluidized bed can be recycled to the fluidized reactor.

Coke produced in the fluid bed reactor circulates to a heater where the coke particles are heated. At times, a portion of the coke particles are burned to heat the remaining coke particles which are recycled back to the reactor providing the heat required to maintain the coking reaction in the fluid bed reactor.

Delayed coking or fluid coking operations are described in greater detail in U.S. Pat. Nos. 3,493,489, 3,537,975, and 3,518,182 the disclosures of which are hereby incorporated by reference into this specification.

The term "highly aromatic oil" as used herein, means a liquid derived from cracking or conversion of crude oil, tar sands, coal, shale or other hydrocarbon sources including pyrolysis tar from ethylene and propylene cracking furnaces which contains above about 60 percent of its carbon atoms as aromatic carbon and boils within a boiling range from about 400° F. to about 1150° F. when measured using the standard ASTM D-1160 test method at 1 millimeter mercury pressure. Many highly aromatic oils, however, can have boiling ranges extending beyond this range. Typically, the highly aromatic oil comprises an oil derived from a fluidized catalytic cracking unit located in the refinery where the coker is located.

In a preferred instance, the highly aromatic oil is selected from one or more materials selected from the group consisting of decanted oil, converted liquid products of tar sands, converted liquid products of coal, converted liquid products of shale, pyrolysis tar from ethylene production (thermal cracking) and pyrolysis tar from propylene production (thermal cracking). Converted products include those liquids produced from the above sources resulting from thermal cracking, hydrocracking, catalytic cracking, hydrotreament or other upgrading process which produce highly aromatic oils.

The highly aromatic oil can also be made up of mixtures of two or more of the above materials if at least 60 percent or more of its carbon atoms are aromatic carbon.

Determining the aromatic carbon percentage (% $C_A$) in the highly aromatic oil is done by nuclear magnetic resonance (NMR) analytical techniques which are well-known to those skilled in the art. The method used quantitatively determines the mole-percent of aromatic carbon in the oil being analyzed by measuring all the carbon atoms in the sample. The value of the percent aromatic carbon atoms is obtained from the value of the aromatic integral divided by the value of the total integral of the generated spectrum (excluding $CDCl_3$).

A $^{13}C$ NMR spectrum of the sample is obtained on a concentrated (greater than 50 weight percent) solution of the sample in either per deuterochloroform or dideuterotetrachloroethane containing 0.08 moles iron acetonylacetonate relaxation reagent. When necessary the sample is heated to insure a homogeneous solution.

The apparatus used is a Nicolet NMC-200 spectrometer which operates at 50.3 MHz for $^{13}C$. The instrument contains routine software for integration of partial spectra. 20 mm precision ground NMR tables are used.

During spectra generation, data are acquired by signal averaging techniques until a sufficient signal to noise ratio is obtained.

A sufficient signal to noise ratio is generally obtained after the exponential multiplier equal to 1 $H_z$ and transformed.

In a preferred instance the highly aromatic oil contains up to 100 percent of decanted oil. In other instances, the highly aromatic oil can contain from about 0 to about 99 weight percent decanted oil and from about 100 to about 1 weight percent oil derived from coal, shale, tar sands or other hydrocarbons.

The term "decanted oil," as used herein, means the heavy bottoms fraction derived from a fluidized catalytic cracking reaction zone. Typically, this oil is removed as the bottom fraction from the fluidized catalytic cracking main column fractionator and boils in a range of from about 450° F. initial boiling point to 1150° F. end boiling point when measured using the standard ASTM D-1160 test method performed at 1 millimeter of mercury pressure. Many decanted oils, however, can have boiling ranges extending beyond this range.

The oil removed directly from the main column is often called slurry oil and will generally contain from about 0.01 up to 4 or more weight percent of fluidized cracking catalyst particles which are typically carried in the hydrocarbon effluent having the fluidized catalytic cracking zone. Generally, the fluidized catalytic cracking catalyst material is a solid-alumina-containing material and usually contains a crystalline aluminosilicate or a crystalline borosilicate. Slurry oil is often sent to tankage or to a storage facility where much of the catalyst particles can settle out. The resulting oil is referred to in the art as a decanted oil. The decanted oil typically will contain less than about 1 weight percent catalyst solids. In this specification and the attached claims, slurry oil and decanted oil shall be used synonymously.

When the highly aromatic oil is decanted oil it can be added at a rate of from about 5 to about 20 weight percent of the feedstock passing into the delayed coker drum. Since the decanted oil contains solid fluidized catalytic cracking catalyst, both the concentration of decanted oil and the amount of catalyst in the decanted oil can be regulated to produce lower yields of improved coke quality (anode coke) and increased liquid yields.

To produce anode grade coke when decanted oil is used, tee silicon content of the produced coke must be less than 200 ppm by weight. This can be accomplished by regulating both catalyst solids concentration in the decanted oil and the amount of decanted oil passed into the coke drum. For most fluidized catalytic cracking catalysts which contain zeolites the amount of catalyst and concentration of decanted oil in the feed entering the coke drum can be varied as shown in Table A below to maintain a silicon concentration in the coke below 200 ppm by weight. The data in Table A assume a residual oil to coke yields of approximately 36 weight percent, a decanted oil to coke yields of approximately 33.5 weight percent, approximately 50 percent by weight of $SiO_2$ in the entrained catalyst, and that an anode grade coke is produced having a maximum of 200 ppm by weight silicon in the coke.

TABLE A

| Wt. % Decanted Oil in Total Residual + Decanted Oil to Coke Drum | Approximate Maximum Silicon in Decanted Oil, ppm by Weight | Approximate Maximum FCC Catalyst in Decanted Oil, ppm by Weight |
|---|---|---|
| 2.5 | 2,900 | 12,300 |
| 5 | 1,400 | 6,200 |
| 10 | 700 | 3,100 |
| 15 | 500 | 2,000 |
| 20 | 360 | 1,500 |

The production of slurry oil or decanted oil from a fluidized catalytic cracker zone is generally well known in the art. The operations of fluidized catalytic cracking zones are described in U.S. Pat. No. 3,909,392, the disclosure of which is hereby incorporated by reference into this specification.

The residual oil passed into the coking zone generally boils within a range of from about 850° F. up to 1250° F. or higher. This material will typically have an initial boiling point of anywhere from 850° F. to about 1150° F. and an end point around 1250° F. using the ASTM D-1160 analytical procedure at 1 millimeter mercury pressure. Many residual oils, however, can have boiling ranges extending above or below this range. The residual oil can also contain heavier materials derived from shale oil, tar sands or coal liquids. Sometimes, the residual oil can be hydrotreated during previous processing.

Distillate oil is also called light gas oil and can be recycled along with residual oil and the highly aromatic oil to the coking unit. Distillate oil recycle helps reduce coke build-up in the coker furnace and transfer line and increases the $C_5+$ liquid yields while reducing the solid coke yield. It can, however, reduce feed throughput to the coking unit since the distillate oil displaces residual oil feed.

Distillate oil generally boils in a range of from about 340° F. initial boiling point to about 750° F. end point using the standard ASTM D-86 analytical procedure. Many distillates can have boiling ranges extending above or below this range. It generally is removed from the coker combination tower as a fraction residing between naphtha an the 650° F.+ gas oil material.

The boiling ranges given above for the various materials described are not meant to unduly restrict the definitions of these materials. Often these materials may have initial or end boiling points outside the stated ranges due to the vagaries which occur during distillation operations in a refinery or in the analytical techniques used. To the extent that these materials boil within the stated boiling ranges, they are to be considered the particular material described above.

The feedstock to the coking zone contains residual oil and, as required by this invention, a highly aromatic oil such as decanted oil. Often a distillate material produced in the coking zone can also be mixed with the residual oil. Typically, the coker feedstock will contain from about 5 to about 20 weight percent of highly aromatic oil and from about 95 to about 65 weight percent of residual oil and from about 0 to about 25 weight percent distillate material. In a more preferred instance, the coker feedstock will contain from about 5 to about 15 weight percent highly aromatic oil, from about 95 to about 75 weight percent residual oil and from about 0 to about 10 weight percent distillate. In a most preferred instance, the feedstock to the coking zone will contain from about 5 to about 10 weight percent highly aromatic oil, from about 95 to about 80 percent of residual feed and from about to about 10 weight percent distillate material.

Benefits associated with using the above concentrations of highly aromatic oil in the feedstock passing into the coking zone include reduced coke production and increased production of $C_5+$ liquids and decreased production of $C_4-$ gas products when compared to operations in which the feedstock to the coking zone contains 100 percent residual feed or 100 percent of a highly aromatic oil such as decanted oil. Additional improvements include improved coke quality represented by a decrease in density of the coke produced. The decreased coke density is a result of less volatile materials contained in the coke which improves the quality of the coke, especially when it is used as anode grade coke. An additional benefit is that shot coke production is reduced or, sometimes, eliminated. The production of shot coke is an especially troublesome problem in delayed coking operations because it tends to cause channelling of cooling water in the coke drum and can plug drainage nozzles at the bottom of the coke drum.

The function of the highly aromatic oil such as decanted oil when mixed with a residual feed in the coking zone can be attributed to any one of several effects. The highly aromatic oil can act as a donor solvent allowing hydrogen to be transferred from it to the liquid products produced in the coking zone. The highly aromatic oil, having a lower boiling range than the residual oil, can also function to strip liquid materials from the already produced solid coke which, if not stripped, would b converted to coke. Additionally, the solubility of the highly aromatic oil for coke precursors may reduce their conversion to coke. The entrained fluidized catalytic cracking catalyst, which is generally present in highly aromatic oils such as decanted oil may play a role in the coking reaction.

We have found, however, that the benefits described above become reduced when the coking temperatures in the coking zone exceed about 950° F. At these higher temperatures, it is speculated that most of the decanted oil is vaporized and has little liquid contact with the resid in the transfer line or with the solid coke or coke precursors in the coking zone.

EXAMPLE I

In this Example, delayed coking pilot plant experiments were run to show the effects of highly aromatic oil addition to a coker residual feed.

Four experiments were run using a commercially available hydrotreated residual feed (Resid Feed A) and a commercially available highly aromatic oil comprising decanted oil (Decanted Oil A) from a commercial fluidized catalytic cracking zone. In one experiment 100 percent Resid Feed A was used. In another experiment 100 percent Decanted Oil A was used. In the other two experiments various mixtures of Resid Feed A and Decanted Oil A were used.

The experiments were performed in a pilot plant delayed coker. The operating conditions for all the experiments was 930° F., feed furnace outlet or transfer line temperature, 16 psig coke drum pressure, 1 weight percent steam addition to the coker feed and a feed rate maintained at about 25 grams per minute of total coker feed. The operations were once-through—the vapors from the coking drums were recovered as liquid and gas products and no coker product was recycled to the coking drum.

The delayed coking pilot unit was operated on an eight hour cycle of which 5 hours consisted of feeding the unit with resid fee.. Two hours of the cycle consisted of steaming the contents of the coke drum followed by 1 hour of baking.

Descriptions of Resid Feed A and Decanted Oil A are shown in Table I below.

TABLE I

| | Hydrotreated Resid Feed A | Decanted Oil A |
|---|---|---|
| API at 60° F. | 5.5 | −3.2 |
| Viscosity, centistokes | | |
| at 40° C. | — | 730 |
| at 100° C. | 1190 | 14.3 |
| at 135° C. | 166 | 5.3 |
| Carbon, wt. % | 87.8 | 90.4 |
| Hydrogen, wt. % | 10.1 | 8.1 |
| Sulfur, wt. % | 1.2 | 1.0 |
| Nitrogen, wt. % | 0.6 | 0.2 |
| Aromatic Carbon (NMR), % | | 70.4 |
| Atomic ratio H/C | 1.4 | 1.1 |
| Oil, wt. % | 40.2 | 31.2 |
| Resins, wt. % | 51.6 | 54.2 |
| Asphaltenes, wt. % | 6.2 | 2.3 |
| Rams Carbon, wt. % | 24.4 | 9.7 |
| 1000° F.-, wt. % | 1.6 | 82.0 |
| Vanadium, ppm | 44 | 4 |
| Nickel, ppm | 41 | 2 |
| Iron, ppm | 78 | 22 |
| Solids, ppm | — | 1,400 avg. |

Using the materials described in Table I, four experiments were run. The only variable among the eleven separate runs made was the composition of the feedstock passing into the delayed coking drum. The eleven runs are reported in Table II below.

TABLE II

| Feed Description | Run No. | Coke Yield, wt. % | $C_5$+ Liquid Yield, wt. % | $C_4$− Gas Yield, wt. % |
|---|---|---|---|---|
| 100% Resid Feed A | 410 | 37.1 | 54.4 | 8.5 |
| | 411 | 35.5 | 55.9 | 8.6 |
| | 412 | 35.7 | 55.7 | 8.6 |
| | 413 | 36.2 | 54.2 | 9.6 |
| | 456 | 36.5 | 54.8 | 8.7 |
| Average | | 36.2 | 55.0 | 8.8 |
| 100% Decanted Oil A | 453 | 32.7 | 61.4 | 5.9 |
| | 457 | 34.4 | 59.8 | 5.8 |
| | 458 | 33.3 | 60.8 | 5.9 |
| Average | | 33.5 | 60.7 | 5.9 |
| Mixture | | | | |
| 50 wt. % Resid Feed A, 50 wt. % Decanted Oil A | 452 | 31.1 | 62.0 | 6.9 |
| | 459 | 31.1 | 61.8 | 7.1 |
| Average | | 31.1 | 61.9 | 7.0 |
| Mixture | | | | |
| 67 wt. % Resid Feed A, 33 wt. % Decanted Oil A | 450 | 32.3 | 60.2 | 7.5 |

The data reported in Table II are plotted in FIGS. 2, 3 and 4.

As can be seen in FIGS. 2, 3 and 4, the pilot data show that additions of decanted oil (a highly aromatic oil) reduce the coke yield (FIG. 2) and the $C_4$− gas yield (FIG. 4) while increasing the $C_5$+ liquid yield (FIG. 3).

In Example 1, the transfer line temperature of the total feed going into the coking drum was 930° F. Higher transfer line temperatures cause coke yields to be reduced. However, addition of the decanted oil caused the coke yield to be reduced even further than the higher temperature experience above.

EXAMPLE II

In this Example the same pilot plant apparatus described for Example I was used except that the transfer line temperature was reduced to 910° F. and a different unhydrotreated residual feed (a virgin material) was used.

The physical description of Resid Feed B is shown in Table III below.

TABLE III

| | Unhydrotreated Resid Feed B |
|---|---|
| API at 60° F. | 5.2 |
| Viscosity, centistokes | |
| at 40° C. | — |
| at 100° C. | 4960 |
| at 135° C. | 523 |
| Carbon, wt. % | 83.6 |
| Hydrogen, wt. % | 10.1 |
| Sulfur wt. % | 4.4 |
| Nitrogen, wt. % | 0.5 |
| Atomic ratio H/C | 1.4 |
| Oil, wt. % | 23.6 |
| Resins, wt. % | 59.1 |
| Asphaltenes, wt. % | 13.5 |
| Rams Carbon, wt. % | 19.8 |
| 1000° F.-, wt. % | 12.0 |
| Vanadium, ppm | 214 |
| Nickel, ppm | 74 |
| Iron, ppm | 9 |

Four different experiments were run using various blend of Decanted Oil A with residual Feed B. Eight separate runs were made and are reported in Table IV below.

TABLE IV

| Feed Description | Run No. | Coke Yield, wt. % | $C_5$+ Liquid Yield, wt. % | $C_4$− Gas Yield, wt. % |
|---|---|---|---|---|
| 100% wt. Resid Feed B | 430 | 28.6 | 62.7 | 8.7 |
| | 433 | 28.9 | 63.0 | 8.1 |
| | 468 | 28.5 | 62.6 | 8.9 |
| Average | | 28.7 | 62.8 | 8.6 |
| 100% wt. Decanted Oil A | 466 | 32.3 | 62.6 | 5.1 |
| | 467 | 34.1 | 60.8 | 5.0 |
| Average | | 33.2 | 61.7 | 5.1 |
| Mixture | | | | |
| 90 wt. % Resid Feed B 10 wt. % Decanted Oil A | 470 | 28.4 | 63.5 | 8.1 |
| | 469 | 28.3 | 63.4 | 8.3 |
| Average | | 28.4 | 63.4 | 8.2 |
| Mixture | | | | |
| 50 wt. % Resid Feed B, 50 wt. % Decanted Oil A | 464 | 28.8 | 65.2 | 6.0 |

The data reported in Table IV are plotted in FIGS. 2, 3 and 4.

As can be seen in FIGS. 2, 3 and 4, the lower transfer line temperature runs (910° F.) for Example II also show reductions in coke and $C_4$− gas yields with decanted oil addition and increases in $C_5$+ liquids. Above about 25 weight percent decanted oil addition at the 910° F. transfer line temperature, coke yield increases with additional decanted oil addition as shown in FIG. 2.

EXAMPLE III

In this Example four tests were conducted at a commercial delayed coking unit located in an existing refinery. The first test was performed with about 6.8 weight percent of a highly aromatic oil comprising a decanted oil using a 902° F. transfer line temperature. The second and third tests were performed without the addition of decanted oil at 902° F. and 923° F. transfer line temperatures respectively. The fourth test was conducted at a transfer line temperature of 927° F. with 6.2 weight percent decanted oil added to the residual feedstock passed into the coking zone. In all four tests a separate distillate recycle was maintained at about 10 volume percent of the total hydrocarbon feed to the coke drum. During the commercial tests there was no light or heavy slop added to the combination tower.

Each test was conducted for 42 consecutive hours using the same two coking drums. Extreme effort was made to keep the coker feedstock qualities fairly constant; however, the feed became slightly heavier during the two-week period over which the tests were performed.

The details of the various tests, average process conditions, fee qualities and overall results are reported in Table V below.

TABLE V

| | Test 1 | | Test 2 | |
|---|---|---|---|---|
| Test Duration, Hrs. | 42 | | 42 | |
| Feed Rate | | | | |
| Resid, BSD | 11504 | | 12369 | |
| Decanted Oil (DCO) BSD | 789 | | 0.0 | |
| wt. %, DCO in Fresh Feed | 6.8 | | 0 | |
| Total Fresh Feed Rate, BSD | 12293 | | 12369 | |
| Distillate Recycle Rate, BSD | 1326 | | 1289 | |
| Average Process Conditions | | | | |
| Furnace Outlet Temperature, °F. | 902 | | 902 | |
| Drum Pressure, psig | 24 | | 24 | |
| Throughput Ratio | 1.02 | | 1.02 | |
| Distillate Recycle Ratio | 10.8 | | 10.4 | |
| Velocity Steam, lbs/hr | 950 | | 950 | |
| Feed Properties | Resid | DCO | Blend | Resid |
| °API at 60° F. | 7.6 | 2.1 | 7.7 | 7.1 |
| Rams Carbon, wt. % | 16.6 | 3.7 | 15.7 | 17.1 |
| Sulfur, wt. % | 3.02 | 2.02 | 2.95 | 3.01 |
| Nitrogen, wt. % | 0.686 | 0.233 | 0.655 | 0.704 |
| H/C Ratio | 1.485 | 1.131 | 1.461 | 1.489 |
| Metals | | | | |
| V, ppm | 470 | | 438 | 470 |
| Ni, ppm | 99 | | 92 | 102 |
| Fe, ppm | 7 | | 7 | 6 |
| Yields | | | | |
| Coke, wt. % | | 28.5 | | 31.0 |
| Coke Volatiles, wt. % | | 10.1 | | 10.6 |
| Coke Bulk Density, g/cc | | 0.87 | | 0.93 |
| Gas Oil (650° F.+), wt. % | | 27.0 | | 24.0 |
| Distillate (360°-650° F.), wt. % | | 24.0 | | 23.7 |
| Naphtha (IBP-360° F.), wt. % | | 11.4 | | 12.2 |
| Total Liquids, wt. % | | 62.4 | | 59.9 |
| Wet Gas, wt. % | | 9.2 | | 9.1 |

TABLE V-continued

| | Test 3 | | Test 4 | |
|---|---|---|---|---|
| Test Duration, Hrs. | 42 | | 42 | |
| Feed Rate | | | | |
| Resid, BSD | 11717 | | 10751 | |
| Decanted Oil (DCO) BSD | 0.0 | | 720 | |
| wt. %, DCO in Fresh Feed | 0 | | 6.2 | |
| Total Fresh Feed Rate, BSD | 11717 | | 11471 | |
| Distillate Recycle Rate, BSD | 1248 | | 1220 | |
| Average Process Conditions | | | | |
| Furnace Outlet Temperature, °F. | 923 | | 927 | |
| Drum Pressure, psig | 24 | | 24 | |
| Throughput Ratio | 1.06 | | 1.09 | |
| Distillate Recycle Ratio | 10.7 | | 10.6 | |
| Velocity Steam, lbs/hr | 930 | | 930 | |
| Feed Properties | Resid | Resid | DCO | Blend |
| °API at 60° F. | 6.3 | 6.8 | 2.1 | 6.9 |
| Rams Carbon, wt. % | 18.1 | 18.0 | 3.7 | 17.1 |
| Sulfur, wt. % | 3.20 | 3.25 | 2.02 | 3.17 |
| Nitrogen, wt. % | 0.755 | 0.724 | 0.233 | 0.694 |
| H/C Ratio | 1.464 | 1.464 | 1.131 | 1.443 |
| Aromatic Carbon (NMR), % | — | — | 63.9 | — |
| Metals | | | | |
| V, ppm | 510 | 510 | | 474 |
| Ni, ppm | 106 | 107 | | 100 |
| Fe, ppm | 6 | 7 | | 7 |
| Yields | | | | |
| Coke, wt. % | 29.6 | | 27.9 | |
| Coke Volatiles, wt. % | 8.8 | | 8.3 | |
| Coke Bulk Density, gm/cc | 1.05 | | 1.00 | |
| Gas Oil (650° F.+), wt. % | 23.2 | | 25.3 | |
| Distillate (360°-650° F.), wt. % | 23.7 | | 23.6 | |
| Naphtha (IBP-360° F.), wt. % | 12.9 | | 12.9 | |
| Total Liquids, wt. % | 59.8 | | 61.8 | |
| Wet Gas, wt. % | 10.6 | | 10.3 | |

As illustrated in Table V, addition of a highly aromatic oil such as decanted oil in Tests 1 and 4 increased -the total liquids produced when compared to generally identical operations (Test 2 and 3) without decanted oil addition. Also, addition of decanted oil reduced the volatiles as shown in Test 1 and 4.

The bulk density of green coke was also reduced in Tests 1 and 4 as shown in Table V.

We claim as our invention:

1. In a delayed coking process for production of coke wherein a feedstock comprising residual oil boiling in a range of from about 850° F. to about 1250° F. is passed into a coking drum at coking conditions to effect the production of fuel grade or anode grade coke, liquid and gaseous products from said feedstock, an improvement wherein said feedstock is mixed with decanted oil having above about 60 percent of its carbon atoms as aromatic carbon and boiling in a range of from about 400° F. to about 1150° F., the resulting feedstock mixture contains from above about 5 to about 20 percent by weight of said decanted oil, and said coking conditions include a coke drum temperature of less than about 950° F., to thereby reduce the yield of coke from said feedstock compared to the yield of coke if said decanted oil were not present in the feedstock.

2. The process of claim 1 further characterized in that said coking conditions include a transfer line temperature of from about 900° F. to about 950° F. and a pressure of from about atmospheric to about 250 psig.

3. The process of claim 1 further characterized in that said highly aromatic oil comprises decanted oil derived from a bottom fraction from a fluidized catalytic cracking process fractionation column.

4. The process of claim 1 further characterized in that said resulting feedstock contains from above about 5 to about 15 percent by weight of said decanted oil.

5. The process of claim 3 further characterized in that said decanted oil contains less than about 6200 ppm by weight of silicon containing catalyst cracking process zone.

6. The process of claim 5 further characterized in that said decanted oil contains less than about 1400 ppm by weight of silicon.

7. The process of claim 3 further characterized in that said feedstock contains from above about 5 to about 10 percent by weight of said decanted oil and said decanted oil contains less than about 6200 ppm by weight of silicon containing catalyst and is derived from a fluidized catalytic cracking process zone.

8. The process of claim 7 further characterized in that said decanted oil contains less than about 1400 ppm by weight of silicon.

9. The process of claim 1 further characterized in that said coke is anode grade coke.

10. In a process wherein a gas oil is converted in a fluidized catalytic cracking process zone to gasoline and other products including the production of decanted oil containing solid particles comprising catalyst used in said zone and wherein a residual oil is passed into a delayed coking zone at coking conditions to effect the production of anode grade coke, liquid and gaseous products from said feedstock, an improvement in the coking process wherein the residual oil is mixed with said decanted oil which contains above about 60 percent of its carbon atoms as aromatic carbon to produce a coker feedstock mixture having from above about 5 to about 15 percent by weight of decanted oil and said coking conditions include a transfer line temperature of less than about 950° F., to thereby reduce the yield of coke produced from said feedstock compared to the yield of coke if said highly aromatic oil were not present in the feedstock.

11. The process of claim 10 further characterized in that said decanted oil contains less than about 6200 ppm by weight of silicon containing catalyst solids and is derived from a fluidized catalytic cracking process zone.

12. The process of claim 11 further characterized in that said feedstock contains from above about 5 to about 10percent by weight of said decanted oil and said decanted oil contains less than about 1400 ppm by weight of silicon.

13. The process of claim 10 further characterized in that said coking conditions include a transfer line temperature of from about 900° F. to about 950° F. and a pressure from about atmospheric to about 250 psig.

* * * * *

UNITED STATES PATENT OFFICE

CERTIFICATE OF CORRECTION

Patent No. 4,832,823 Dated May 23, 1989

Inventor(s) SHRI K. GOYAL - GARY S. FAAGAU

It is certified that error appears in the above-identified patent and that said Letters Patent is hereby corrected as shown below:

| Col. | Line | |
|---|---|---|
| Abstract | 6 | "froma bout" should be -- from about -- |
| 1 | 8 | "which" should be -- in which -- |
| 2 | 27 | "from" should be -- from a -- |
| 2 | 45 | "coke" should be -- coke. -- |
| 5 | 45 | "tee" should be -- the -- |
| 5 | 65 | "an" should be -- and -- |
| 8 | 52 | "tee" should be -- the -- |
| 9 | 43 | "an" should be -- and -- |
| 10 | 1 | "about to" should be -- about 0 to -- |
| 10 | 32 | "b" should be -- be -- |
| 11 | 3 | "fee.." should be -- feed. -- |
| 13 | 27 | "fee" should be -- feed -- |
| 14 | 27 | "-the" should be -- the -- |
| 14 | 64 | "catalyst cracking" should be -- catalyst solids and is derived from a fluidized catalytic cracking -- |

UNITED STATES PATENT OFFICE

CERTIFICATE OF CORRECTION

Patent No. 4,832,823 Dated May 23, 1989

Inventor(s) SHRI K. GOYAL - GARY S. FAAGAU

It is certified that error appears in the above-identified patent and that said Letters Patent is hereby corrected as shown below:

| Col. | Line | |
|---|---|---|
| 16 | 15 | "10percent" should be -- 10 percent -- |

Signed and Sealed this

Sixth Day of February, 1990

*Attest:*

JEFFREY M. SAMUELS

*Attesting Officer*

*Acting Commissioner of Patents and Trademarks*